US008322279B2

(12) United States Patent
Demange et al.

(10) Patent No.: US 8,322,279 B2
(45) Date of Patent: Dec. 4, 2012

(54) MARKING OR LABELING MACHINE AND METHOD

(75) Inventors: Florent Demange, Valleiry (FR); Marco Paita, Oyonnax (FR); Philippe Demond, La Pendue Echallon (FR); David Mandon, Oyonnax (FR)

(73) Assignee: CER, Oyonnax (FR)

( * ) Notice: Subject to any disclaimer, the term of this patent is extended or adjusted under 35 U.S.C. 154(b) by 387 days.

(21) Appl. No.: 12/729,110

(22) Filed: Mar. 22, 2010

(65) Prior Publication Data

US 2010/0242762 A1 Sep. 30, 2010

(30) Foreign Application Priority Data

Mar. 24, 2009 (FR) ..... 09 51898

(51) Int. Cl.
*B41F 17/08* (2006.01)

(52) U.S. Cl. ..... 101/38.1; 101/35; 101/37; 101/40; 101/407.1

(58) Field of Classification Search ..... 101/27, 101/33, 34, 35, 36, 37, 38.1, 39, 40, 40.1, 101/407.1, 475, 116, 123, 124
See application file for complete search history.

(56) References Cited

U.S. PATENT DOCUMENTS

| | | | | |
|---|---|---|---|---|
| 3,260,194 | A * | 7/1966 | Karlyn | 101/38.1 |
| 5,471,924 | A | 12/1995 | Helling | |
| 5,553,547 | A * | 9/1996 | Miller | 101/485 |
| 5,603,259 | A * | 2/1997 | Gross et al. | 101/33 |
| 6,397,742 | B1 * | 6/2002 | Proctor et al. | 101/124 |
| 7,845,273 | B2 * | 12/2010 | Dumenil et al. | 101/44 |
| 8,104,856 | B2 * | 1/2012 | Tezuka et al. | 347/9 |
| 2001/0042456 | A1 * | 11/2001 | Kamen et al. | 101/38.1 |
| 2007/0084361 | A1 | 4/2007 | Dumenil | |
| 2007/0199455 | A1 | 8/2007 | Paita | |
| 2009/0071352 | A1 | 3/2009 | Dumenil | |

FOREIGN PATENT DOCUMENTS

DE 200 14 177 U1 10/2000

* cited by examiner

*Primary Examiner* — Ren Yan
(74) *Attorney, Agent, or Firm* — Dowell & Dowell, P.C.

(57) ABSTRACT

A machine for marking or labeling circularly symmetrical work pieces includes a marking or labeling member, elements for moving the member and a workpiece relative to each other in a first direction, and a cradle for holding a workpiece while it is being marked or while a label is being applied to it. The cradle includes components for moving the workpiece in rotation around an axis of revolution thereof. A drive carriage drives the cradle in translation in a second direction that is perpendicular to the first direction. There are components that drive the carriage in translation in a third direction that is perpendicular to the first and second directions. Other components make it possible to drive the cradle relative to the carriage in rotation about a first axis that is parallel to the first direction.

13 Claims, 5 Drawing Sheets

MARKING OR LABELING MACHINE AND METHOD

BACKGROUND OF THE INVENTION

FIELD OF THE INVENTION

The invention relates to a machine for marking or labeling circularly symmetrical workpieces and a method of using such a machine for marking or labeling a workpiece that is at least partially frustoconical.

DESCRIPTION OF THE RELATED ART

In the field of hot-marking circularly symmetrical workpieces, it is known that a punch or a printing plate can be moved towards the outside surface of a workpiece to be marked, with a marking ribbon being interposed, thereby making it possible to form a pattern on the outside surface of the workpiece. A pneumatic actuator or an electric motor is used for moving the punch towards the workpiece or for moving the workpiece towards the punch. While it is being marked, the workpiece must be held in a cradle that is moved in translation, under the punch, while the workpiece is being moved in rotation around its axis of revolution, thereby making it possible to mark the workpiece over its periphery. That operates correctly for cylindrical workpieces of circular section, it being recalled that particular provisions can be taken for specially shaped workpieces, i.e. cylindrical workpieces of non-circular section, as explained in Document FR-A-2 897 555.

When the workpiece to be marked is at least partially frustoconical, the movement of the cradle must be modified in order to make it possible for the outside surface of the workpiece to bear against the marking ribbon without slipping. For that purpose, it is known that the cradle can be installed on a carriage mounted at the end of a connecting rod hinged about an axis parallel to the direction of relative movement of the punch and of the carriage. In order to cause the carriage to move, it is necessary for its mechanical drive devices to be adjusted accurately, it being necessary to re-adjust said drive devices accurately each time the geometrical shape of the workpiece to be marked changes. In view of the inertia of the workpieces moved in rotation, the frame and the drive rollers of the carriage are subjected to considerable amounts of stress that significantly reduce their lifetimes. In addition, since the path of the support is a circularly arcuate path that it is constrained to follow by the moving mechanical members, the loading and unloading stations for loading the workpieces to be marked into the cradle and for unloading them therefrom must be inclined so that the longitudinal axes of the workpieces in said loading and unloading stations are aligned with radii passing through the centre of rotation of the connecting rod. As a result, the manipulator arm used for loading the workpieces into the cradle is relatively complex and must be adapted to accommodate each usage configuration.

It is possible to consider using a multi-axis polymorphic robot for moving a frustoconical workpiece relative to a marking punch. However, the paths of a multi-axis robot are not as accurate as those obtained by means of a carriage moved in translation or in rotation. In addition, in such a robot, the workpieces are generally held cantilevered out, so that they might be deformed under the radial load exerted by the marking punch. Finally, a multi-axis robot is a costly piece of equipment, in particular when its price is compared with the maximum load that it can move.

Analogous problems arise with other marking machines, in particular screen-printing marking machines, and with labeling machines, whenever the workpieces are partially or totally frustoconical.

An object of the invention is, more particularly, to remedy those drawbacks by proposing a novel machine that makes it possible to mark circularly symmetrical workpieces reliably and effectively, regardless of whether said workpieces are cylindrical or frustoconical.

To this end, the invention provides a machine for marking or labeling circularly symmetrical workpieces, said machine comprising:

- a marking or labeling member;
- means for moving the member and a workpiece to be marked or labeled relative to each other in a first direction;
- a cradle suitable for holding a workpiece while it is being marked or labeled, said cradle being provided with means for driving the workpiece in rotation around the axis of revolution thereof; and
- a drive carriage for driving the cradle in translation in a second direction that is perpendicular to the first direction.

Said machine is characterized in that it further comprises: means for driving the carriage in translation in a third direction that is perpendicular to the first and second directions; and means for driving the cradle relative to the carriage in rotation around a first axis that is parallel to the first direction.

SUMMARY OF THE INVENTION

By means of the invention, the means for driving the carriage in translation in the third direction and the means for driving the cradle in rotation relative to the carriage make it possible to cause the cradle to follow a path that can have a circularly arcuate portion that is compatible with marking or with applying a label to a frustoconical portion of the workpiece, while also preserving the advantage of simplicity and of reliability procured by driving the carriage by movements in translation only.

In advantageous but non-essential aspects of the invention, such a machine may incorporate one or more of the following characteristics, taken in any technically feasible combination:

- The axis about which the cradle is mounted to move in rotation relative to the first carriage intersects the longitudinal axis of a workpiece held by the cradle.
- The means for driving the carriage in translation comprise a bed on which the carriage is mounted in such a manner as to have the possibility of moving in translation in the second direction, said bed itself being mounted to move in translation relative to a stationary carrier structure in a third direction. In these circumstances, it is possible to make provision for the carriage to be moved in translation relative to the bed in the second direction by screw-and-nut drive means, while the bed is moved in translation relative to the stationary carrier structure in the third direction by belt drive means.
- The means for driving the workpiece in rotation in the cradle, for driving the cradle in rotation relative to the carriage, and for driving the carriage in translation in the second and third directions comprise four brushless-type motors and at least one synchronized control unit for controlling said motors in synchronized manner. Such a structure imparts considerable freedom to the way the workpieces to be marked can be moved relative to the punch of the machine.

The machine further comprises means for adjusting the position of the cradle relative to the carriage, in rotation around a second axis that is perpendicular to the first direction. This adjustment makes it possible to adapt the position of the outside generator line of the workpiece to be marked that faces towards the marking or labeling member, so as to obtain parallelism between said outside generator line and the active face of said member. In these circumstances, it is possible to make provision for the machine further to comprise means for driving the cradle in rotation around the second axis.

In a first embodiment of the invention, the machine is a hot-marking machine, the marking member is a hot punch, means are provided for bringing a marking ribbon between the punch and a workpiece to be marked, and the first direction is perpendicular to a portion of the ribbon disposed between the punch and the workpiece to be marked.

In a second embodiment of the invention, the machine is a screen-printing machine and the marking member is an inked screen.

In a third embodiment of the invention, the machine is a machine for applying labels from a web, and the member is an "applicator" that is suitable for applying a label against each workpiece to be labeled.

The invention also provides a method of marking or of labeling a circularly symmetrical workpiece that is at least partially frustoconical, said method being implemented by means of a machine as mentioned above, and comprising steps consisting in:

a) loading the workpiece into the cradle in a loading station;

b) moving the cradle equipped with the workpiece along a path going from the loading station to an unloading station and including at least one circularly arcuate portion centered on a second axis that is parallel to the first direction, by moving the carriage in translation in the second and third directions and by causing the cradle to move in rotation relative to the carriage about the first axis that is parallel to the first direction;

c) causing the marking or labeling member and the workpiece to move relative to each other in the first direction in such a manner as to press a marking or labeling element against the workpiece for at least some fraction of the movement of the cradle along the path of step b); and d) unloading the workpiece from the cradle in the unloading station.

Such a method makes it possible to mark or to label a frustoconical workpiece in a manner that is particularly reliable.

In an advantageous aspect, the path followed by the cradle in step b) includes at least one rectilinear portion parallel to the second direction, and situated before or after the circularly arcuate portion while, when it is in the loading and/or unloading stations, the cradle takes or holds the workpiece in a position in which the projection of its axis of revolution on a plane containing the second and third directions is parallel to the third direction. This makes it possible to use tools for loading, and, where applicable, unloading the workpiece relative to the cradle that are the same for a cylindrical workpiece and for a frustoconical workpiece, regardless of the geometrical shape of the workpiece.

In another advantageous aspect of the invention, the cradle is oriented, relative to the carriage and about an axis that is perpendicular to the first direction, in a manner such that the outside generator line of the portion of the workpiece that is being marked or labeled is parallel to an active surface of the marking or labeling member.

BRIEF DESCRIPTION OF THE DRAWINGS--.

The invention can be better understood and other advantages of the invention appear more clearly from the following description of an embodiment of a machine that complies with the principle of the invention, and of an implementation of a method of using said machine, the description being given merely by way of example and with reference to the accompanying drawings, in which.

DESCRIPTION OF THE PREFERRED EMBODIMENTS

Figure 1:
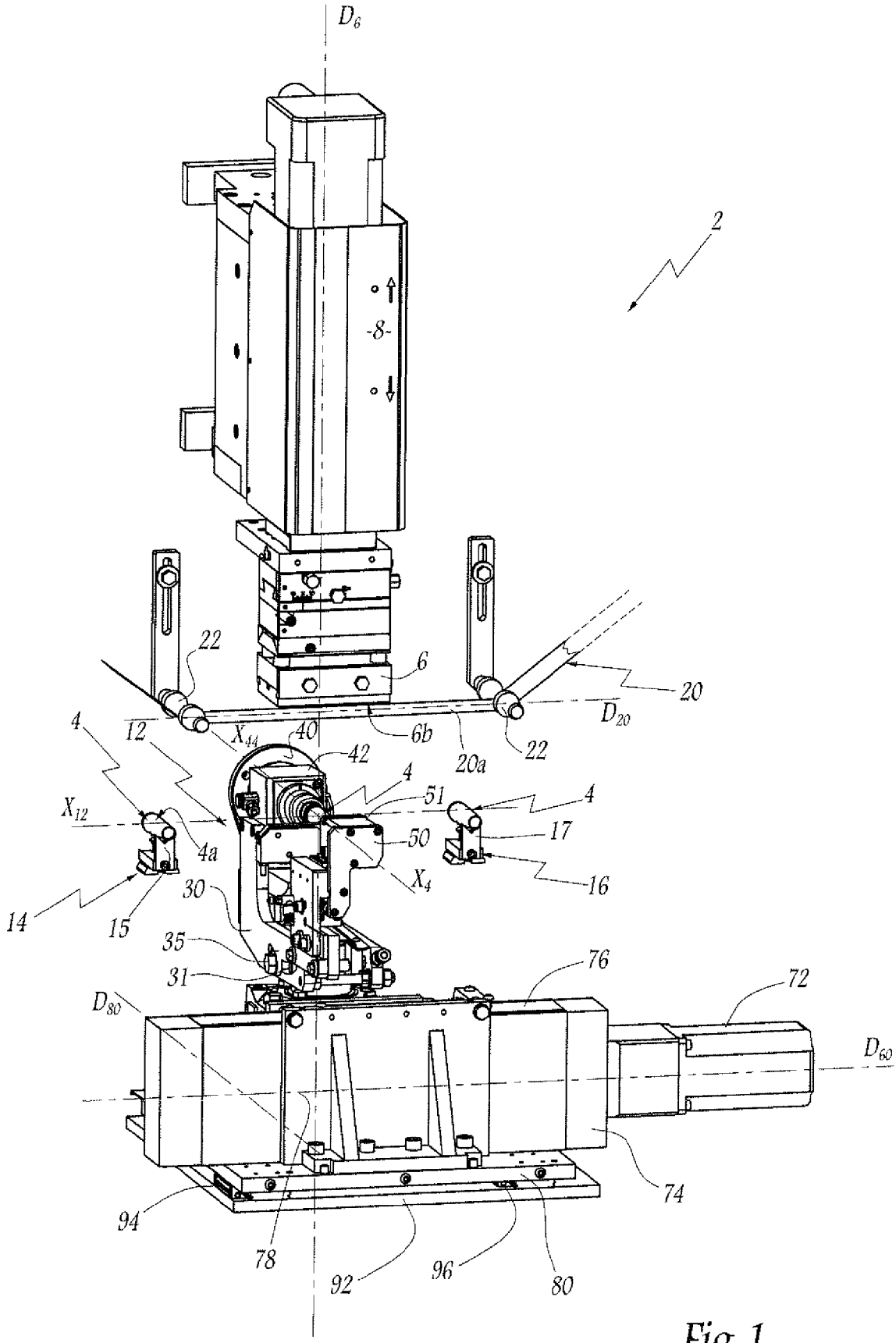
FIG. 1 is a fragmentary diagrammatic front perspective view of a hot-marking machine of the invention.

The machine 2 shown in the figures serves for hot-marking circularly symmetrical workpieces 4 that, in the example, are small bottles of cosmetic that have a frustoconical shape over a substantial portion of their length. The machine 2 is adapted to hot-marking cylindrical workpieces that are totally frustoconical or partially frustoconical.

The machine 2 includes a punch 6 that is heated by means (not shown and known per se), such as electrical resistor elements, and that is mounted to be moved by a pneumatic actuator 8, in a vertical direction $D_6$. Other linear actuators may be used in place of the actuator 8.

The machine 2 also includes a cradle 12 designed to support one of the workpieces 4 while it is being marked.

Figure 2:
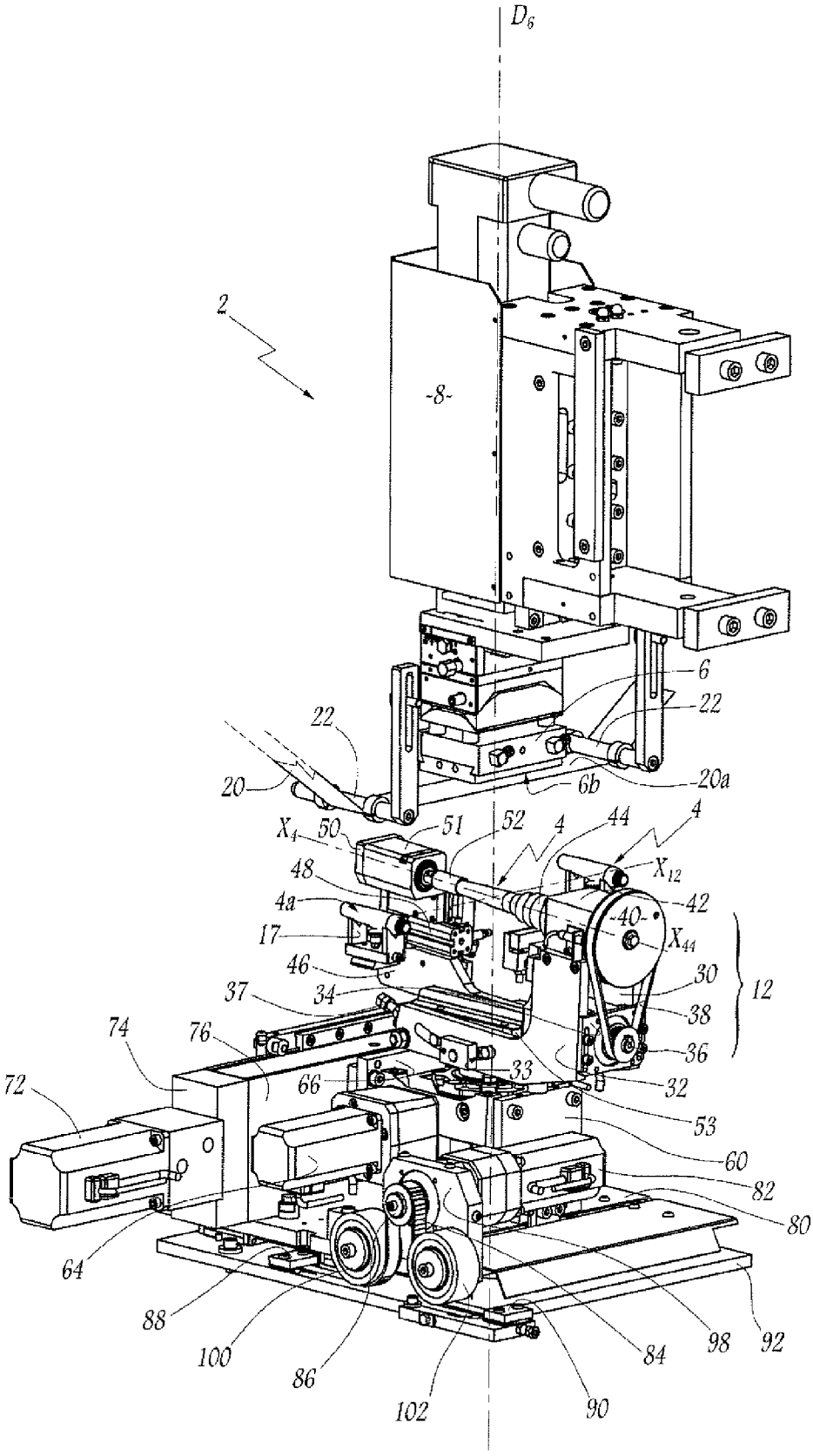
FIG. 2 is a perspective view of the machine of FIG. 1, seen from behind.

In FIGS. 1 and 2, the vertical offset between the punch 6 and the cradle 12 is exaggerated so as to make it possible to see certain portions of the machine.

Figure 3:
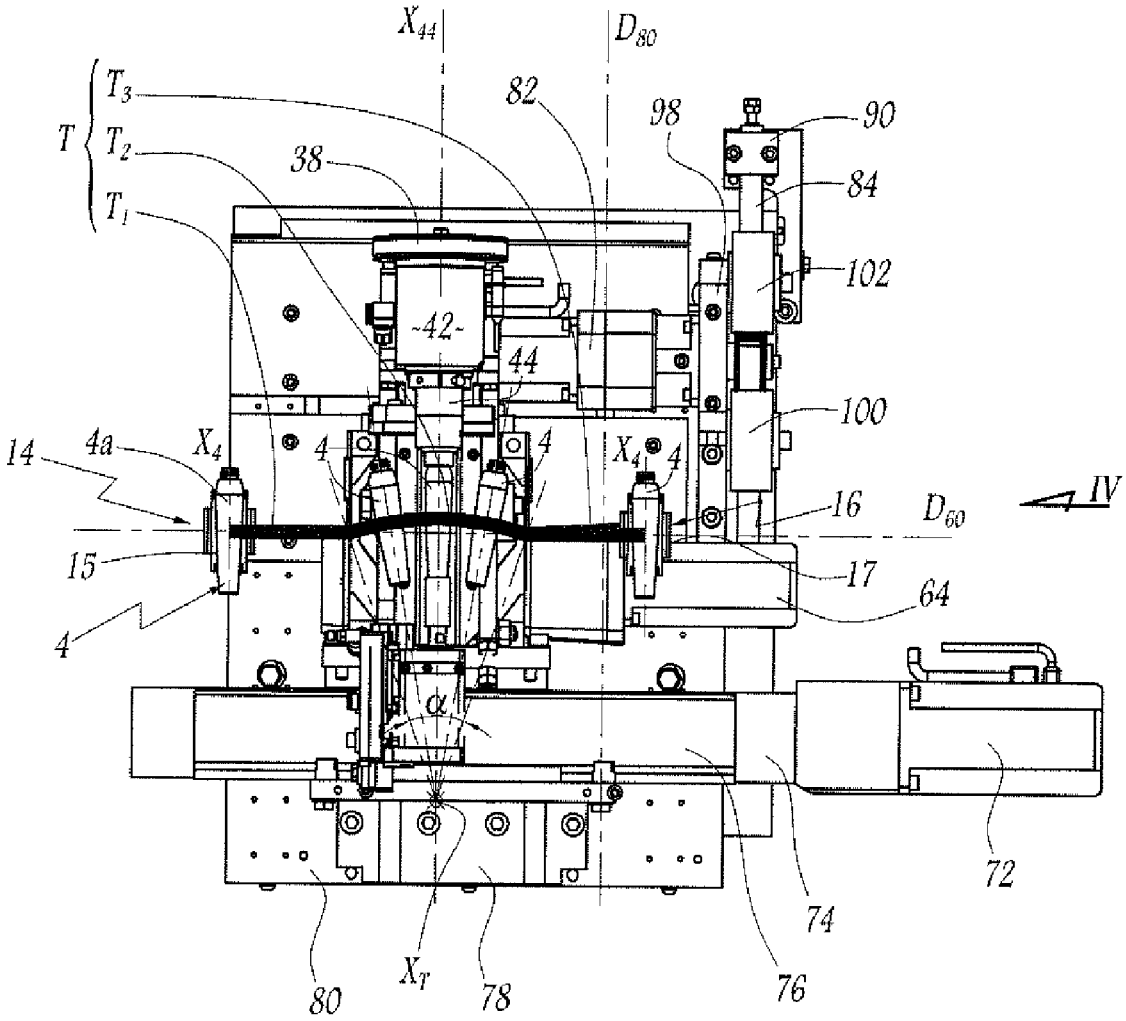
FIG. 3 is a view from above showing the lower portion of the machine of FIGS. 1 and 2.

FIGS. 1 to 3 show a plurality of small bottles 4 in a plurality of positions inside the machine 2, in order to show various positions taken up by a small bottle while it is being moved from a bottle-loading station 14 to the cradle 12 and to an unloading station 16. In practice, the cradle 12 carries a single bottle at a time and another bottle can be propositioned in the loading station 14, while another bottle is in the unloading station, e.g. for an inspection operation.

A reel (not shown) is provided with a quantity of marking ribbon 20 that travels from the reel to another reel (not shown) for collecting the ribbon after it has been used. Deflector rollers 22 make it possible to define the path for the ribbon 20 between the punch 6 and a workpiece 4 supported by the cradle 12. The portion 20*a* of the ribbon 20 that is situated between the rollers 22 and that extends as flat, travels in a direction $D_{20}$ that is perpendicular to the direction $D_6$.

The cradle 12 is made up of two plates 30 and 32 between which a brushless motor 34 is disposed, which motor has an outlet shaft 36 that is connected via a belt 38 and via an output 40 that, via a bearing 42, drives a mandrel 44 for holding a workpiece 4. The mandrel rotates about an axis $X_{44}$ that is parallel to the axes of rotation of the shaft 36 and of the pulley. In addition, a plate 46 is mounted to move relative to the plates 30, 32 in a direction that is parallel to the axes of rotation of the motor 34 and of the pulley 40 and to the axis $X_{44}$. A pneumatic actuator 48 makes it possible to control the position of the plate 46 relative to the plates 30 and 32. The plate 46 supports an angle bracket 50 on which a support 51 is mounted, which support carries a sleeve 52 designed to cooperate with that end of a bottle 4 that is not in engagement with the mandrel 44. The workpieces 46 to 52 moving parallel to the axis $X_{44}$ makes it possible to exert a pinching force between the mandrel 44 and the sleeve 52, thereby making it possible to hold a workpiece 4 via its two ends under the punch 6, when said workpiece is to be marked by transfer from the ribbon 20.

The cradle 12, which comprises the parts 30 to 52, is used to move each workpiece or bottle 4 from the loading station 14 to the unloading station 16, while also driving it in rotation around the axis $X_{44}$ that then coincides with the axis of revolution $X_4$ of the workpiece 4 supported by the cradle 12. In practice, the axes $X_4$ and $X_{44}$ are substantially horizontal, while being inclined relative to a horizontal plane at an angle equal to the half-angle at the vertex of the frustoconical portion of the workpiece 4.

The cradle 12 also has includes a deck 53 that extends between the plates 30 and 32. This deck is secured to a pin 54 that is that is cylindrical and of circular section and that extends along an axis $X_{54}$ that is parallel to the direction $D_6$. That end of the pin 54 that is opposite from the deck is provided with a gear wheel 56 making it possible to drive the pin 54 in rotation and to drive the cradle 12 as a whole in rotation around the axis $X_{54}$, as indicated by the curved double-headed arrow $R_1$ in FIG. 5.

The cradle 12 is mounted on a carriage 60, while the pin 54 is inserted into a corresponding recess 62 provided in the carriage 60, and in which a bevel gear wheel (not shown) projects that is mounted on the outlet shaft of a brushless motor 64 that is secured to the carriage 60. Thus, the motor 64 makes it possible to drive the cradle 12 in rotation around the axis $X_{54}$ and relative to the carriage 60.

In a variant (not shown) of the invention, the gear wheel 56 may be omitted from the pin 54, and said pin may be inserted in a hollow shaft forming the outlet of a worm screw and wheel reducing gear mounted on the outlet of the motor 64.

The axis $X_{54}$ intersects the axis of revolution $X_4$ of each workpiece 4 held by the cradle 12.

The carriage 60 is itself mounted on a plate 66 that is secured to a nut 68 mounted on a threaded rod 70 driven in rotation by a brushless motor 72.

The motor 72 thus makes it possible, by means of the screw-and-nut connecting rod constituted by the elements 68 and 70, to drive the carriage 60 and the cradle 12 supported by said carriage in translation in a direction $D_{60}$ perpendicular to the axis $X_{54}$ and to the direction $D_6$, as indicated by the double-headed arrow $F_2$.

The motor 72 is mounted on a base 74 belonging to a box 76 in which the threaded rod 70 and the nut 72 are received. The box 76 is supported by an angle plate 78 bolted to a bed 80 on which a brushless motor 82 is installed, which motor has its outlet shaft aligned on an axis $X_{82}$ parallel to the direction $D_{60}$.

A cog belt 84 is wrapped over about 180° around an outlet gear wheel 86 of the shaft of the motor 82. The ends of the belt 84 are fastened via securing devices 88 and 90 to a base 92 that forms a stationary support structure for the elements 12 to 86.

Rails 94 and 96 make it possible to guide the bed 80 in translation relative to the base 92.

The motor 82 is mounted on a support 98 that is fastened to the bed 80 and that supports two wheels 100 and 102 that are mounted idle, and that serve to deflect the belt 84 towards the devices 88 and 90, from the gear wheel 86.

Thus, by actuating the motor 82, it is possible to cause the gear wheel 86 to rotate and to cause the support 98 and the bed 80 to move in translation relative to the base 92 in a direction $D_{80}$ perpendicular to the directions $D_6$ and $D_{60}$, as indicated by the double-headed arrow $F_3$.

The construction used to transmit the movement between the motor 82 and the bed 80, by means of the belt 84, is adapted to the fact that the movement in translation of the bed 80 in the direction $D_{80}$ has an amplitude and accelerations that are relatively small. The screw-and-nut drive used to move the carriage 60 in the direction $D_{60}$ is adapted to movements in translation of relatively large amplitude that must be controlled very accurately.

Figure 5:
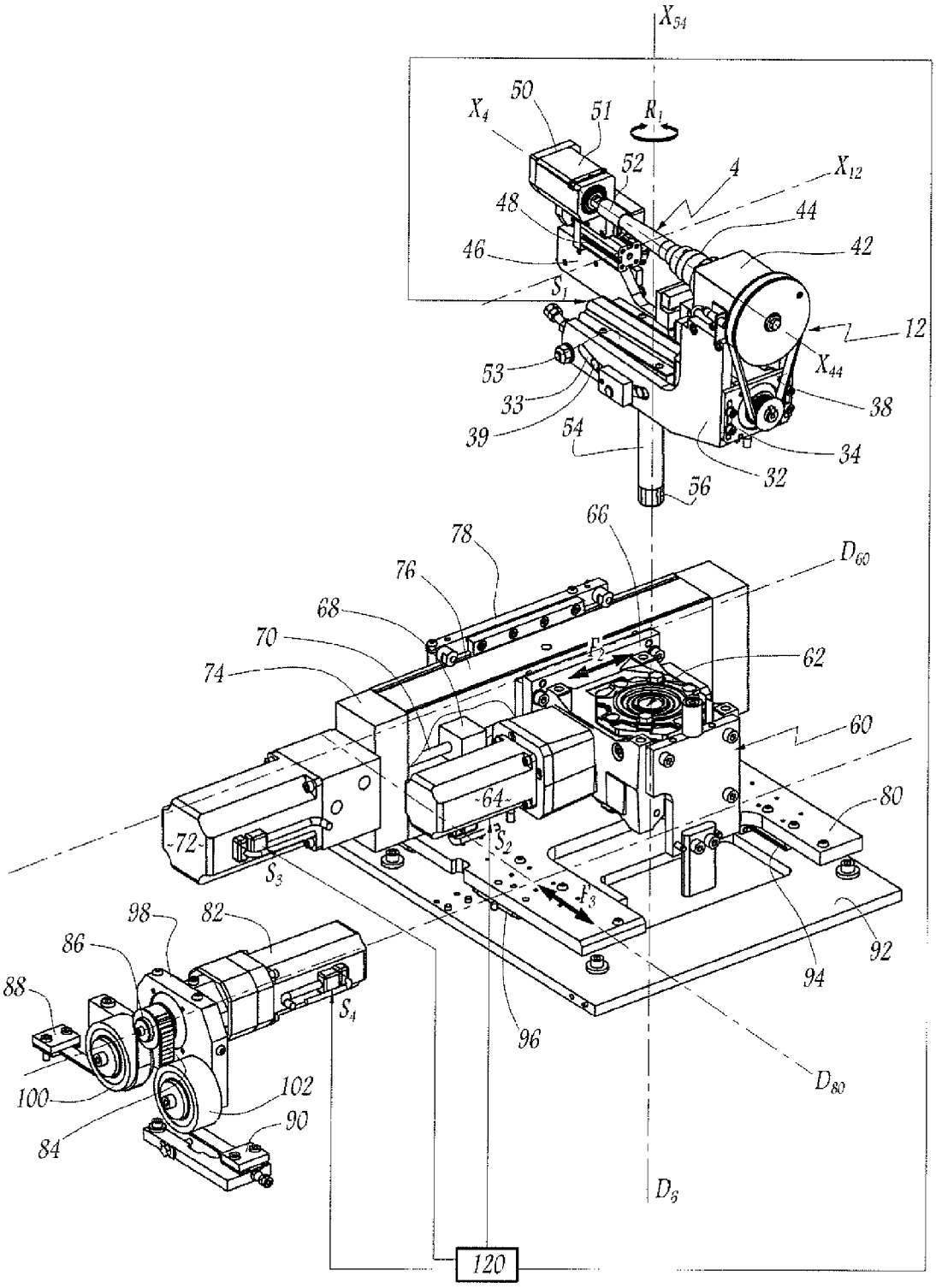
FIG. 5 is an exploded perspective view of certain component elements of the machine of FIGS. 1 to 4.

The four brushless motors 34, 64, 72, and 82 are connected to an electronic unit 120 that is shown very diagrammatically, in FIG. 5 only, and that makes it possible to control said motors in synchronized manner in order to obtain a predetermined movement of a bottle 4 supported by the cradle 12. In FIG. 5, the arrows $S_1$ to $S_4$ respectively represent the electronic control signals issued by the unit 120 for controlling the motors 34, 64, 72, and 82.

The parameters defining the path followed by the bottle 4 supported by the cradle 12 can be adapted easily by programming the stages during which the brushless motors 64, 72, and 82 are actuated, without using devices having cams, wheels, or levers that are complex and that must be changed for each new path that is desired. In other words, the use of the three brushless motors 64, 72, and 82 imparts high flexibility in the use of the machine 2 of the invention.

By appropriately programming the unit 120, it is possible to cause a bottle mounted in the cradle 12 to follow a path T going from the loading station 14 to the unloading station 16, and having the geometrical shape shown by the thick line in FIG. 3.

This path includes a rectilinear portion $T_1$ that extends parallel to the direction $D_{60}$ and that is obtained by actuating the motor 72 only.

The path T also includes a circularly arcuate portion $T_2$ centered on an axis $X_T$ parallel to the direction $D_6$, i.e. perpendicular to the directions $D_{60}$ and $D_{80}$. The axis $X_T$ does not coincide with the axis $X_{54}$. This circularly arcuate portion $T_2$ makes it possible to cause the outside frustoconical surface **4*a* of a bottle 4 to roll against that face of the ribbon 20 that is opposite from the punch 6, thereby making it possible for a marking pattern to be transferred without slipping onto the surface 4*a*. As can be seen more particularly in FIG. 3, the longitudinal axis $X_4$ of a bottle 4 extends radially relative to the axis $X_T$ and changes orientation relative thereto while a bottle 4** is moving along the circular arc formed by the path portion $T_2$.

The path T also includes a rectilinear portion $T_3$ that extends parallel to the direction $D_{60}$ and that makes it possible to bring the marked bottle to the unloading station 16. Said portion $T_3$ is obtained by actuating the motor 72 only.

As appears more particularly from FIG. 3, the horizontal projection of the longitudinal axis $X_4$, i.e. the axis of revolution, of a bottle 4 received on the support 15 of the loading station 14 or on the support 17 of the unloading station 16 is parallel to the direction $D_{60}$, i.e. perpendicular to the directions $D_6$ and $D_{60}$, independently of the exact geometrical shape of each bottle 4, and of the portion $T_2$ of the path T. Indeed, the geometrical shape of the path T is adapted to match the geometrical shape of the workpieces to be marked 4, in particular as a function of the cone angle of their frustoconical portions, by programming operation of the motors

64, 72, and 82 to obtain a circularly arcuate path $T_2$, even though rectilinear portions $T_1$ and $T_3$ remain. Under these circumstances, the manipulators used for loading each bottle 4 into the cradle 12 and, where applicable, for unloading a bottle from said cradle can be standard pieces of equipment used for cylindrical workpieces to be marked, operation of which manipulators is not modified due to the frustoconical shape of the bottles 4. This constitutes significant progress compared with the prior art equipment in which a path that is totally circularly arcuate is obtained by the connecting nod, requiring manipulators that are dedicated to each type of circularly arcuate path.

It should be noted that the vertex angle $\alpha$ of the circularly arcuate path portion $T_2$ is relatively small, it being less than 40° and preferably about 20°, so that the elements that are moved in rotation are moved over a stroke of angular amplitude that is relatively small, thereby limiting the mechanical stresses of the drive and support elements compared with when a circularly arcuate path extends between the stations 14 and 16.

The invention is shown in FIG. 3 in the situation where the circularly arcuate portion $T_2$ of the path T is centered, relative to the rectilinear portions $T_1$ and $T_3$, on an axis $X_T$ situated on the same side as the sleeve 52. However, as a function of the geometrical shape of the workpieces to be marked, it is possible to make provision for said axis $X_T$ to be situated on the same side as the bearing 42, merely by programming operation of the brushless motors 64, 72, and 82, by means of the unit 120.

The structure of the drive means 12 and 30 to 102 for driving the bottles 4 relative to the punch 6 also makes it possible to load a workpiece 4 between the mandrel 44 and the sleeve 52 without said sleeve slipping relative to the support 15 of the loading station 14. It is possible to bring the mandrel 44 into alignment with the axis $X_4$ of a bottle 4 supported by the support 15 and then to move the bed 80 in a direction such that it brings the mandrel 44 closer to the bottle 4, while also actuating the actuator 48 to move the sleeve 52 towards the workpiece 4, so that the workpiece 4 is "pinched" between the mandrel 44 and the sleeve 52, without slipping parallel to its axis of revolution relative to the support 15. Any risk of the outside surface 4*a* of a bottle being scratched is thus avoided.

Figure 6:
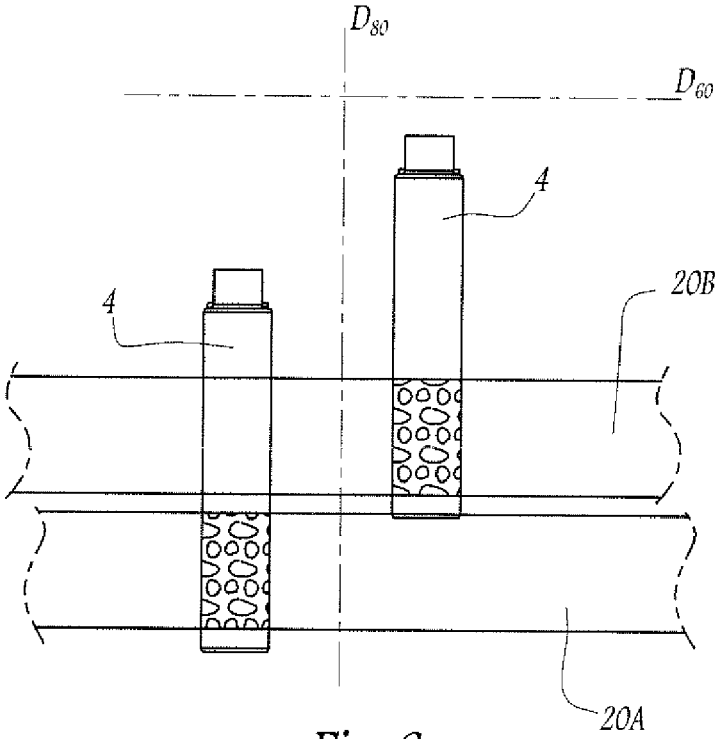
FIG. 6 is a diagram showing the operating principle of a portion of the machine of FIGS. 1 to 5, during marking of a cylindrical workpiece with two ribbons of different colors.

The possibility for movement that results from using the motor 82 also makes it possible to mark the same zone of an article with two colors, as shown diagrammatically in FIG. 6 for a bottle 4 of cylindrical shape and of circular section. Two ribbons 20A and 20B may be disposed side-by-side under a punch such as the punch 6 shown in FIGS. 1 and 2. A bottle can then be disposed in a first position shown on the left of FIG. 6 for marking it with a first pattern, with the ribbon 20A, e.g. that is golden in color.

By actuating the motor 82 appropriately, it is possible to move the bottle 4 parallel to the direction $D_{80}$ while also moving it parallel to the direction $D_{60}$ by means of the motor 72, so as to reach the position shown on the right of FIG. 6, in which position a pattern of a second color, e.g. black, can be applied, by means of the ribbon 20B to the same zone of the bottle 4 as the zone marked previously by means of the ribbon 20A.

It should be noted that, in this situation, movement in the direction $D_{60}$ is not essential. The bottle 4 may be brought successively into register with the ribbons 20A and 20B by being moved in the direction $D_{80}$ only.

The machine 2 may be used for marking cylindrical workpieces independently of two-color marking. In these circumstances, the motors 64 and 82 are not actuated, except for the motor 82 being moved, where necessary, for decoration position corrections or when loading a workpiece into the cradle 12.

The machine of the invention is thus advantageous both for marking circularly symmetrical workpieces of frustoconical shape, and for marking circularly symmetrical workpieces of cylindrical shape, it being understood that the possibility of marking by means of two ribbons that is mentioned above with reference to a cylindrical workpiece may also be implemented for a workpiece that is partially or totally frustoconical.

Figure 4:
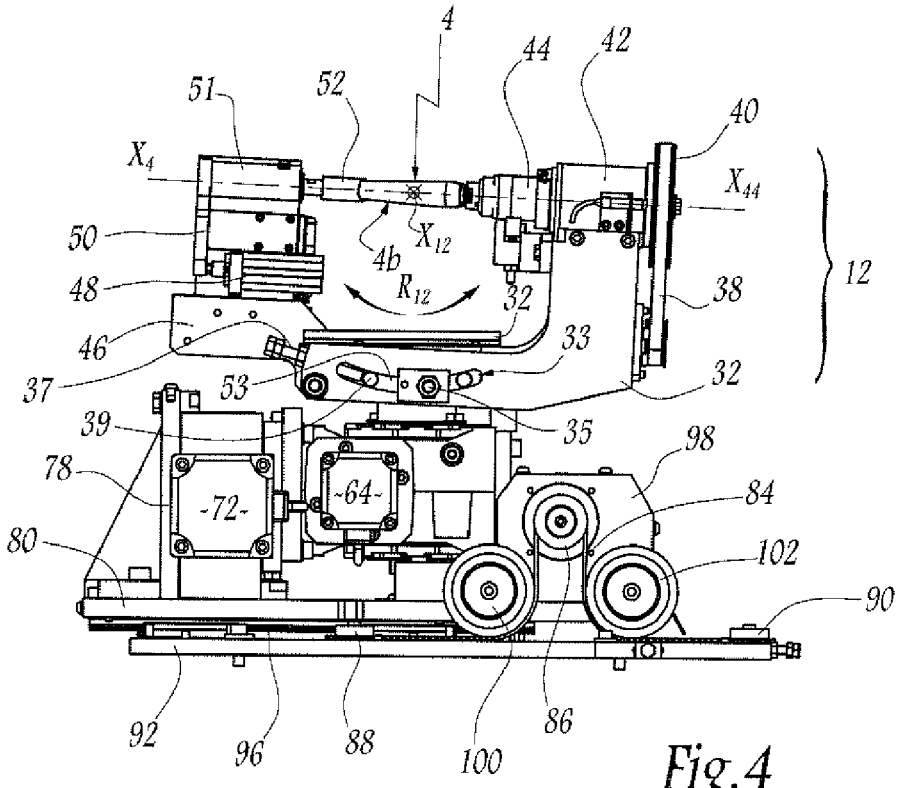
FIG. 4 is a side view seen looking in the direction indicated by the arrow IV of FIG. 3.

For a frustoconical workpiece, the generator line 4*b* of the outside surface 4*a* of a bottle 4 is not parallel to its axis of revolution $X_4$. If said axis of revolution is horizontal, i.e. perpendicular to the direction $D_6$ of relative movement between the punch 6 and the bottle 4, the generator line 4*b* in question is inclined relative to the marking surface 6*b* of the punch 6 that is perpendicular to the direction $D_6$. In order to correct this, the cradle 12 is mounted relative to the deck 53 in such a manner as to have the possibility of pivoting about an axis $X_{12}$ perpendicular to the direction $D_6$. For this purpose, each of the plates 30 and 32 is provided with a circularly arcuate slot 31 or 33 centered on the axis $X_{12}$ and in which a bolt 35 is engaged. A respective adjustment screw 37 bears against a pin 39 secured to or integral with the deck 53 and is engaged in each of the slots 31 and 33, thereby making it possible to adjust the angular positions of the plates 30 and 32 about the axis $X_{12}$ accurately. Once the desired position is reached, the bolt 35 just has to be tightened in order to hold the cradle 12 stationary about the axis $X_{12}$. This makes it possible to dispose the generator line 4*b* parallel to the marking surface 6*b* of the punch 6, i.e., in practice, horizontally in the example shown in the figures, for a series of workpieces 4 to be marked. The possibility for the cradle 12 to pivot about the axis $X_{12}$ is indicated by arrow $R_{12}$ in FIG. 4.

The axes $X_{12}$ and $X_{44}$ intersect each other. In practice, the axes $X_{12}$, $X_{44}$, and $X_{54}$ intersect one another in the centre of each bottle 4 supported by the cradle 12, which center is defined as being a point on the axis $X_4$ that is equidistant from the ends of the bottle.

In an aspect of the invention that is advantageous but that is not shown, it is possible for the movement of the cradle 12 about the axis $X_{12}$ to be motor-driven, so that the position of the generator line 4*b* of a frustoconical workpiece can be adjusted during marking. This is particularly advantageous for a workpiece whose cone angle varies, in particular for a workpiece having two frustoconical surfaces with cone angles of opposite signs. In which case, first marking can take place with a first adjustment of the orientation of the cradle 12 about the axis $X_{12}$, and then second marking can take place on another portion of the outside surface of the workpiece to be marked, by means of a second adjustment of the position of the cradle 12 about the axis $X_{12}$.

The invention is shown in the situation when the direction $D_6$ is vertical. However, the invention is applicable to other configurations, in particular when the direction in which the punch and the workpiece to be marked move towards each other is horizontal.

The invention is shown in the situation in which the movement of the punch relative to the workpiece to be marked is a movement in translation effected by the actuator 8. However, the invention is applicable to the situation in which the punch follows a circularly arcuate path. In such a situation, the end portion of the path in which the punch and the workpiece to be marked move towards each other can be approximated as being parallel to a straight line normal to a marking face of the punch. In a variant (not shown) of the invention, the punch may be stationary and the workpiece to be marked is moved towards the punch in the direction $D_6$.

The invention is described above and shown in the accompanying drawings for an embodiment in which it is applied to a marking machine, which is entirely advantageous.

The invention may also be implemented for a screen-printing machine, in which case a workpiece to be marked is to be moved facing an inked screen that forms a marking member, whose function is comparable to the above-mentioned punch 6.

The invention is also applicable, in another embodiment, to a labeling machine, and more precisely to a machine for applying labels, in which machine a web on which labels are disposed travels to the vicinity of workpieces to be labeled, while a presser member or applicator periodically presses the web against the outside surfaces of the workpieces to be labeled, in order to apply labels to said surfaces. Regardless of whether they are cylindrical or conical, the workplaces to be labeled must be moved relative to the label applicator and the invention can be implemented for this purpose.

The invention claimed is:

1. A machine for marking or labeling circularly symmetrical work pieces, the machine comprising:

a marking or labeling member;

means for moving the marking or labeling member and a workpiece relative to each other in a first direction;

a cradle for holding a workpiece while it is being marked or while a label is being applied to it, the cradle being provided with drive means for driving the workpiece in rotation around an axis of revolution thereof; and a drive carriage for driving the cradle in translation in a second direction that is perpendicular to the first direction;

the machine also including:

means for driving the drive carriage in translation in a third direction that is perpendicular to the first and second directions; and means for driving the cradle relative to the carriage in rotation about a first axis that is parallel to the first direction.

2. The machine according to claim 1, wherein the first axis intersects a longitudinal axis of a workpiece held by the cradle.

3. The machine according to claim 1, wherein the means for driving the carriage in translation includes a bed on which the carriage is mounted in such a manner as to move in translation in the second direction, and the bed being mounted to move in translation relative to a stationary carrier structure in the third direction.

4. The The machine according to claim 3, wherein the carriage is moved in translation relative to the bed in the second direction by a screw-and-nut drive means, while the bed is moved in translation relative to the stationary carrier structure in the third direction by belt drive means.

5. The machine according to claim 1, wherein the means for driving the workpiece in rotation in the cradle, for driving the cradle in rotation relative to the carriage, and for driving the carriage in translation in the second and third directions comprise four brushless-type motors and at least one synchronized control unit for controlling the motors in a synchronized manner.

6. The machine according to claim 1, further including means for adjusting the position of the cradle relative to the carriage in rotation around a second axis that is perpendicular to the first direction.

7. The machine according to claim 6, further including means for driving the cradle in rotation around the second axis.

8. The machine according to claim 1, wherein the machine is a hot-marking machine, wherein the marking member is a hot punch, wherein the machine further includes means for bringing a marking ribbon between the punch and a workpiece to be marked, and wherein the first direction is perpendicular to a portion of the ribbon disposed between the punch and the workpiece.

9. The machine according to claim 1, wherein the machine is a screen-printing machine and wherein the marking member is an inked screen.

10. the machine according to claim 1, wherein the machine is a machine for applying labels from a web, and wherein the marking or labeling member applies a label against each workpiece to be labeled.

11. A method of marking or of labeling a circularly symmetrical workpiece that is at least partially frustoconical, the method being implemented by means of a machine according to claim 1, and comprising steps consisting in:

a) loading the workpiece into the cradle in a loading station;

b) moving the cradle equipped with the workpiece along a path going from the loading station to an unloading station and including at least one circularly arcuate portion centered on a second axis that is parallel to the first direction by moving the carriage in translation in the second and third directions and by causing the cradle to move in rotation relative to the carriage about the first axis that is parallel to the first direction;

c) causing the marking or labeling member and the workpiece to move relative to each other in the first direction in such a manner as to press a marking or labeling element against the workpiece for at least some fraction of the movement of the cradle along the path of step b); and d) unloading the workpiece from the cradle in the unloading station.

12. The method according to claim 11, wherein the path followed by the cradle in step b) includes at least one rectilinear portion parallel to the second direction, and situated before or after the circularly arcuate portion while, when the cradle is in the loading and/or unloading stations, the cradle takes or holds the workpiece in a position in which the projection of the axis of revolution of the workpiece on a plane containing the second and third directions is parallel to the third direction.

13. The method according to claim 11, wherein the cradle is oriented, relative to the carriage and about an axis that is perpendicular to the first direction, in a manner such that an outside generator line of a portion of the workpiece that is being marked or labeled is parallel to an active surface of the marking or labeling member.

* * * * *